United States Patent [19]

Larsson et al.

[11] 4,253,314

[45] Mar. 3, 1981

[54] PLANT FOR COOLING HEATED GOODS

[75] Inventors: Bertil S. V. Larsson, Tyresö; Stefan A. J. Bokfors, Stockholm, both of Sweden

[73] Assignee: AB Svenska Flaktfabriken, Nacka, Sweden

[21] Appl. No.: 45,740

[22] Filed: Jun. 5, 1979

[30] Foreign Application Priority Data

Jun. 9, 1978 [SE] Sweden ..... 7806733

[51] Int. Cl.[3] ..... F25B 25/00

[52] U.S. Cl. ..... 62/332; 62/374

[58] Field of Search ..... 62/63, 65, 374, 375, 62/380, 332

[56] References Cited

U.S. PATENT DOCUMENTS

| | | | |
|---|---|---|---|
| 3,507,128 | 4/1970 | Murphy et al. | 62/63 |
| 3,826,100 | 7/1974 | Vahl | 62/375 |
| 3,881,322 | 5/1975 | Le Diouron | 62/63 |

*Primary Examiner*—Ronald C. Capossela

*Attorney, Agent, or Firm*—Dann, Dorfman, Herrell and Skillman

[57] ABSTRACT

In a plant for cooling heated goods, for instance cast iron, the goods is transported in a predetermined direction through one or several cooling sections (1,2,3). Through the tunnels a closed piping system (4) transports a fluid in a direction which is opposite to the transportation direction of the goods. The piping system also comprises at least one heat exchanger in which at least part of the heat from the goods is transferred to the fluid under the intermediary of a separate cooling medium which is brought in direct contact with the goods. A considerable part of the heat being emitted from the goods can thereby be transferred to the fluid and the heat energy thus taken care of can either be converted to electric energy or be directly used for heating purposes.

5 Claims, 4 Drawing Figures

PLANT FOR COOLING HEATED GOODS

Figure 1:
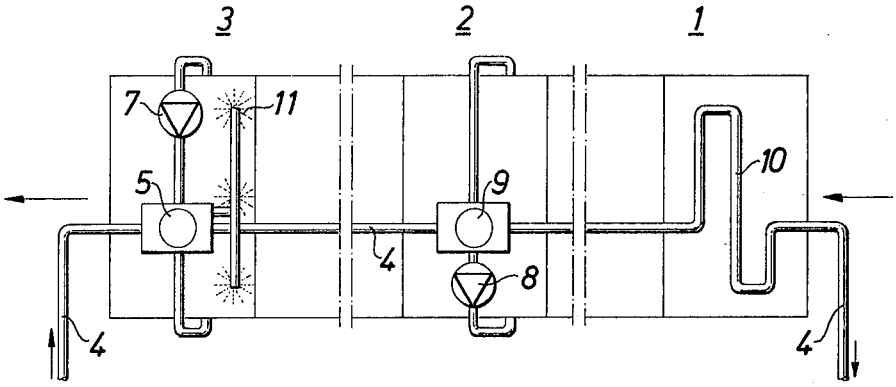

The present invention relates to a plant for cooling heated goods, comprising at least one cooling section through which the goods is transported in a path and in which the goods transmits the heat to a fluid which is flowing through the cooling section in a direction opposite the direction of transportation of the goods.

There are many different areas within which a plant according to the present invention can be utilized in order to save energy by utilizing the heat which is stored in the heated goods. The heat energy thus collected can be converted to electric energy or can be used for the heating of premises and hot-water. Up till now few attempts have been made to safeguard the heat energy which is emitted from heated goods when it is cooled in a cooling plant. There are cooling plants in the form of tunnels where the airflow through the tunnel is utilized to control the temperature gradient in the goods when it is transported through the tunnel. In these plants hitherto known the cooled-off heat energy is, however, not taken care of.

The object of the present invention is to realize an efficient energy saving plant by collecting the main part of the heat which is stored in the goods cooled in a cooling plant and which hitherto has been wasted.

This object is realized in a plant according to the present invention substantially by the fact that the fluid is flowing through the cooling section in a closed piping system comprising means for heat exchange in which at least part of the heat emitted from the goods is transferred to the fluid under the intermediary of a separate cooling medium which is brought in direct contact with the goods.

As initially indicated the invention can be utilized in a number of different areas where cooling plants for heated goods are utilized. A very important use which can become of great economical importance is in connection with the steel manufacture where up till now not many attempts have been made to safeguard the heat energy stored in the goods after the different steps which the steel has to pass in the manufacturing process. Usually, casting of some kind is part of the first step such as chill casting or continuous casting, whereafter the castings have to cool before they are treated in the next step of manufacture which for instance can include processing in a rolling mill. Since the moulding floor and the rolling mill often are located in different areas the mouldings have to cool in specific stores before they can be transported from the moulding floor and to the rolling mill. Consequently, between these stages of processing a certain store-keeping has to take place since the manufacture within each of these steps must be self-contentious and independent of the variations in capacity in the preceding step, for instance due to disturbances in the manufacturing process. The cast iron is preheated before it is transported into the rolling mill in which the temperature of the goods is further increased due to the mechanical treatment. When the milling operation is finished the material has extremely high temperature and it has to cool after this step before the final step which includes controlled heat treatment of the material. Even between the second and third steps it can be applicable with a certain buffer storing for the same reasons as mentioned above. In the final heat treatment the material is heated once more to suitable temperatures and then permitted to cool in controlled environment in order to obtain the desired material properties. Steel and cast iron are heated to extremely high temperatures, for instance for stress releaving anneal and the cooling operation can be accomplished either rapidly or with controlled temperature gradient.

In utilizing the invention in connection with steel manufacture it would be possible to safeguard the heat in the goods after each step of manufacture instead of permitting all stored heat energy to be wasted as has usually been the case up till now.

Figure 2:
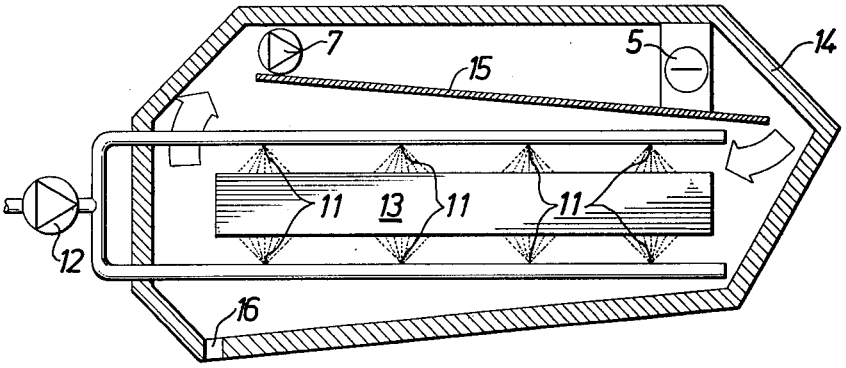
Figure 3:
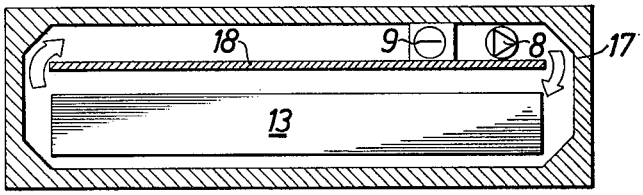
Figure 4:
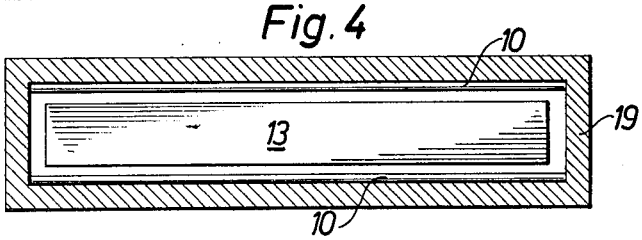

One embodiment of the invention will now be described by way of example with reference to the accompanying drawings in which FIG. 1 is a schematic view of a plant for cooling heated goods according to the invention comprising three cooling sections, FIG. 2 is a cross section of a plant accoding to FIG. 1 showing a water cooled section, FIG. 3 is a cross section of an air cooled section according to FIG. 1, and FIG. 4 is a cooling section for collecting the heat radiation from the goods in a plant according to FIG. 1.

The cooling plant according to FIG. 1 comprises three cooling sections 1, 2 and 3 through which heated goods is successively transported under the cooling process in the direction indicated by the arrows which means from right to left on the Figure. This means that the heated goods first enters section 1, then goes into section 2 and finally passes through section 3. In the plant a closed piping system 4 is transporting a fluid in the opposite direction relative to the goods, which means from the left to the right on the Figure. The transport fluid is thus first entering section 3, therefrom it is flowing to section 2 and finally to section 1 and under this transportation the fluid is successively heated. The fluid is preferably a liquid, for instance water, liquid ammonia, liquid natrium or Freon. The heating of the fluid can result in evaporation with possible superheating. The embodiment described in FIGS. 1–4 is primarily intended to utilize water as transport fluid.

When the water in the piping system 4 first enters section 3 it has a temperature of about 20° C. and after passing through a heat exchange system the temperature has increased to about 80° C. In this section which is the final section for the heated goods transported through the cooling plant the goods has its lowest temperature and consequently in this section water can be utilized also as cooling medium. The water is sprayed towards the goods and the water steam which is thereby formed is sucked away by a fan 7 and passed through a heat exchanger 5 where the heat and the condensation energy is transmitted to the transport fluid.

In section 2 the transort fluid as well as the goods have higher temperatures and consequently in this step air is preferably utilized as cooling medium. The air is blown by means of a fan 8 substantially perpendicular to the direction of transportation of the goods whereby it is heated and then passed through a heat exchanger 9 in which the heat energy of the air is transmitted to the fluid. The temperature of the fluid after the heat exchanger 9 is about 200° C.

Finally, the fluid is flowing into section 1 in which the goods temperature is the highest and where consequently the heat transfer coefficient is highest. The piping system for the transport fluid is in this section provided with increased contact areas for instance in the form of loops 10 which are located as closeas possible to the goods. When the fluid leaves cooling section 1 the temperature is about 350° C. which in case the fluid is in the form of water when entering section 3, here the water has been converted to superheated steam. The superheated steam can be utilized in many different ways, for instance it can be directly used for the traction of turbines to convert the collected heat energy into electric energy or it can also be used for heating of air and water, for instance preheating of ventilation air for premises and houses or hot-water heating.

The plant shown in FIG. 1 can suitably be formed in the shape of a tunnel through which the goods is successively transported and thereby cooled at the same time as the fluid is heated. FIG. 2 shows the third section also shaped as a tunnel 14 in which water from the nozzles 11 are sprayed against the upper and lower surfaces of the goods 13 by means of a pump 12. The tunnel 14 is divided in an upper and a lower channel by means of a longitudinal baffle 15 and the water steam which is created in the lower channel when the water is sprayed over the goods 13 is sucked away by the fan 7 and passed through the heat exchanger 5 which is positioned in the upper channel. The water steam which has a temperature of about 100° C. immediately after the fan 7 is condensating in the heat exchanger 5 whereby the heat and condensation energy is transmitted to the transport fluid. The temperature of the cooling medium immediately after the heat exchanger is about 30° C. Since the cooling medium in this section substantially is in the form of water the tunnel 14 must be provided with a drainage 16 for the condensate and the excess water.

The second section according to FIG. 3 is also formed in the shape of a tunnel but here the cooling medium is air instead of water. Even this cooling section 17 is divided in an upper and a lower channel by means of a longitudinal baffle 18 where the goods 19 is located in the lower channel whereas the fan 18 is located in the upper channel to circulate the air with a speed of about 15 m/s through both channels and the heat exchanger 9. The baffle 18 is simultaneously converting the radiation heat from the cast steel 13 into convection heat through the heating of the air flowing over the baffle surfaces. The convection surfaces in the tunnel are thereby increased both in the upper and in the lower channels for the air which circulates through this cooling section.

Even the first cooling section shown on FIG. 4 is made in the shape of a tunnel 19 in which the loops 10 of the piping system 4 are arranged with surface magnification in the walls, the ceiling and the floor of the tunnel. In this section the temperature of the goods is extremely high, which means that the heat transfer from the goods to the transport fluid substantially occurs through heat radiation. When the fluid has passed this section it has consequently reached its highest temperature and can be utilized in a suitable way for heat and/or energy generation. Due to the high temperature in this cooling section certain problems may arise in the transportation of the goods through the tunnel but these problems can be solved by a suitable design of the transportation arrangement.

The cooling sections described above can of course be divided into several steps in order to achieve the most efficient way to take care of the heat from the goods. The transportation speed of the goods can moreover be automatically controlled by detecting the goods temperature and controlling the volume of the cooling medium which is circulated within each step.

What we claim is:

1. A plant for cooling heated goods, comprising at least one cooling section having a passage and means to transport the goods in a path through said passage and a piping system for a first heat exchange fluid which is flowing through the cooling section in a direction opposite the direction of transportation of the goods to cool the goods and heat the first heat exchange fluid by indirect heat exchange, said piping system comprising heat exchange means, and means to circulate a separate cooling medium through said section, first in direct contact with the goods and thereafter into said heat exchange means to further cool the goods and to further heat said first heat exchange fluid.

2. A plant according to claim 1, characterized in that at least two cooling sections are serially arranged and comprise said transportation paths for the goods and said piping system for the fluid with a heat exchange means in each section, and that said further heat transfer from the goods to the first heat exchange fluid in one section is accomplished by means of a first separate cooling medium and in the other section by means of a second separate cooling medium.

3. A plant accoding to claim 2, characterized in that one cooling section comprises means for circulation of the first cooling medium in the form of a gas, and absorption surfaces of metal to convert the heat radiation from the goods to convection heat when the cooling gas is flowing over the absorpiton surfaces and the goods, and that the other cooling section comprises means for circulation of the second cooling medium in the form of a liquid, into contact with the goods, whereby the cooling liquid is evaporated when contacted with the goods, and thereafter in the form of gas through said heat exchange means.

4. A plant accoding to claim 3, characterized in that the second cooling section comprises means of drainage of condensate and excess cooling liquid.

5. A plant according to claim 1, characterized in that the passage is in the shape of a tunnel through which the heated goods is transported, and that each cooling section comprises at least one cooling step.

* * * * *